US008594543B2

(12) United States Patent
Krucinski et al.

(10) Patent No.: US 8,594,543 B2
(45) Date of Patent: Nov. 26, 2013

(54) COLOR-TO-COLOR REGISTRATION FOR BELT PRINTING SYSTEM

(75) Inventors: Martin Krucinski, Webster, NY (US); Barry P. Mandel, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 287 days.

(21) Appl. No.: 13/025,646

(22) Filed: Feb. 11, 2011

(65) Prior Publication Data

US 2012/0207518 A1 Aug. 16, 2012

(51) Int. Cl.
*G03G 15/01* (2006.01)

(52) U.S. Cl.
USPC ..... 399/301; 399/49; 399/72

(58) Field of Classification Search
USPC ..... 399/301, 49, 72
See application file for complete search history.

(56) References Cited

U.S. PATENT DOCUMENTS

| | | | | |
|---|---|---|---|---|
| 5,200,791 | A | 4/1993 | Dastin et al. | |
| 7,046,947 | B1 * | 5/2006 | Castelli et al. | 399/307 |
| 7,206,008 | B2 | 4/2007 | Dejong et al. | |
| 7,280,789 | B2 * | 10/2007 | Iwasaki | 399/299 |
| 7,444,101 | B2 | 10/2008 | Calamita | |
| 7,558,510 | B2 * | 7/2009 | Iwasaki | 399/167 |
| 7,586,512 | B2 | 9/2009 | Aoki et al. | |
| 8,204,416 | B2 * | 6/2012 | Calamita et al. | 399/301 |
| 2010/0135702 | A1 | 6/2010 | Calamita et al. | |
| 2011/0076045 | A1 * | 3/2011 | Sobue | 399/81 |

* cited by examiner

*Primary Examiner* — David Gray
*Assistant Examiner* — Carla Therrien
(74) *Attorney, Agent, or Firm* — Hoffman & Baron, LLP

(57) ABSTRACT

Embodiments described herein include a multi-color printing system in which color-to-color registration errors due to cyclical belt motion errors are minimized. A belt for transporting a substrate media or at least a partial image into a plurality of panels is segmented. A first one of the panels has a first location on the belt for receiving substrate media or a partial image. A first belt motion error value corresponding to the first one of the panels on the belt is identified and at least one image marking unit is calibrated to counteract the first belt motion error corresponding to the first one of the panels.

26 Claims, 4 Drawing Sheets

COLOR-TO-COLOR REGISTRATION FOR BELT PRINTING SYSTEM

BACKGROUND

1. Technical Field

The presently disclosed embodiments are directed to calibrating a printing system to counteract printing imperfections from color-to-color registration errors.

2. Brief Discussion of Related Art

Printing systems can utilize belts during the printing process for carrying and transporting images and/or substrate media. For example, printing systems can include a media transport belt for transporting substrate media through a printing section of the printing system and/or can include intermediate transfer belts on which images can be formed before transferring the images to substrate media.

In multi-color printing systems color-to-color registration errors can result from non-ideal motion of the belts utilized during the printing process. For example, belts can shift or wander as they rotate about rollers causing the belts to deviate from their expected position or path. These cyclical belt motion errors can vary as the belt revolves about the rollers such that different points on the belt can experience different belt motion errors. The color-to-color registration errors can be manifested as printing imperfections that reduce the print quality of a printing system.

SUMMARY

According to aspects illustrated herein, there is provided a multi-belt printing system that includes first and second printing stations, a rotating media transport belt, and a controller. The first and second printing station each include a rotating intermediate transfer belt having image panels, a marking unit configured to dispose marking material on the image panels, and a transfer point at which the marking material is transferred to substrate media from the image panels. The rotating media transport belt has media panels adapted to support the substrate media thereon. The media transport belt is configured to transport the media panels past each transfer point to facilitate transfer of the marking material to the substrate media from the image panels. The image panels of the first and second printing stations periodically coincide with at least one of the media panels at the transfer point associated with the image panels to form panel combinations. The controller controls the marking unit of at least one of the first and second printing stations to adjust placement of the marking material individually for each of the panel combinations to compensate for combined registration errors associated with each of the panel combinations.

According to aspects illustrated herein, there is provided a direct marking printing system that includes print heads, a rotating media transport belt, and a controller. The print heads print images on substrate media. The rotating media transport belt has a media panels to support the substrate media. The media transport belt is configured to transport the media panels past the print heads. Each of the media panels being associated with an image placement correction factor to compensate for registration errors of the media panels with respect to at least one of the print heads as the media transport belts transports the media panels past the print heads. The controller controls a first one of the print heads to adjust placement of the marking material individually for each of the media panels in response to the image placement correction factors.

According to aspects illustrated herein, there is provided a method of compensating registration errors in a printing system. The method includes identifying panel combinations. Each of the panel combination includes an image panel from a first intermediate transfer belt, an image panel from a second intermediate transfer belt, and a media panel from a media transport belt. The image panel from the first intermediate transfer belt periodically coincides with the media panel at a first transfer point and the image panel from the second intermediate transfer belt periodically coincides with the media panel at a second transfer point. The method also includes identifying image placement correction factors for each of the panel combinations. The image placement correction factors are used to compensate for registration errors associated with the panel combinations. The method further includes controlling a marking unit associated with one of the first and second intermediate transfer belts to adjust placement of the marking material individually for each of the panel combinations in response to the image placement correction factors.

According to aspects illustrated herein, there is provided a method of compensating for registration errors in a printing system. The method includes identifying image placement correction factors used to compensate registration errors associated with media panels of a rotating media transport belt and a print head and transporting the media panels past the print head. Each media panel is adapted to support substrate media on which a marking material is disposed by the print head. The method also includes controlling the print head to adjust placement of a marking material with respect to each media panel individually for each of the media panels in response to the image placement correction factors.

According to aspects illustrated herein, there is provided a system to compensate for registration errors in a multi-belt printing system. The system includes a computer storage device, a first and second marking unit, and a controller. The computer storage device stores image placement correction factors for each panel combination. Each of the panel combination includes an image panel from a first rotating intermediate transfer belt, an image panel from a second rotating intermediate transfer belt, and a media panel from a rotating media transport belt. The image panel from the first intermediate transfer belt periodically coincides with the media panel at a first transfer point and the image panel from the second intermediate transfer belt periodically coincides with the media panel at a second transfer point. The first marking unit is associated with the first intermediate transfer belt to dispose a first marking material on the image panel of the first intermediate transfer belt. The first marking material is transferred to the media panel at the first transfer point. The second marking unit associated with the second intermediate transfer belt to dispose a second marking material on the image panel of the second intermediate transfer belt. The first marking material being transferred to the media belt at the second transfer point. The controller controls the second marking unit to adjust placement of the second marking material in response to the image placement correction factors to compensate for a combined registration error associated with each panel combination.

According to aspects illustrated herein, there is provided a method of compensating registration errors in a printing system. The method includes disposing a first marking material on substrate media supported on media panels of a rotating media transport belt, disposing a second marking material on the substrate media, and determining a registration error based on a position of the second marking material with respect to the first marking material for each media panel. The method also includes generating a set of image placement correction factors corresponding to the error associated with each media panel, the image placement correction factors being used to compensate for the errors.

DETAILED DESCRIPTION

Figure 1:
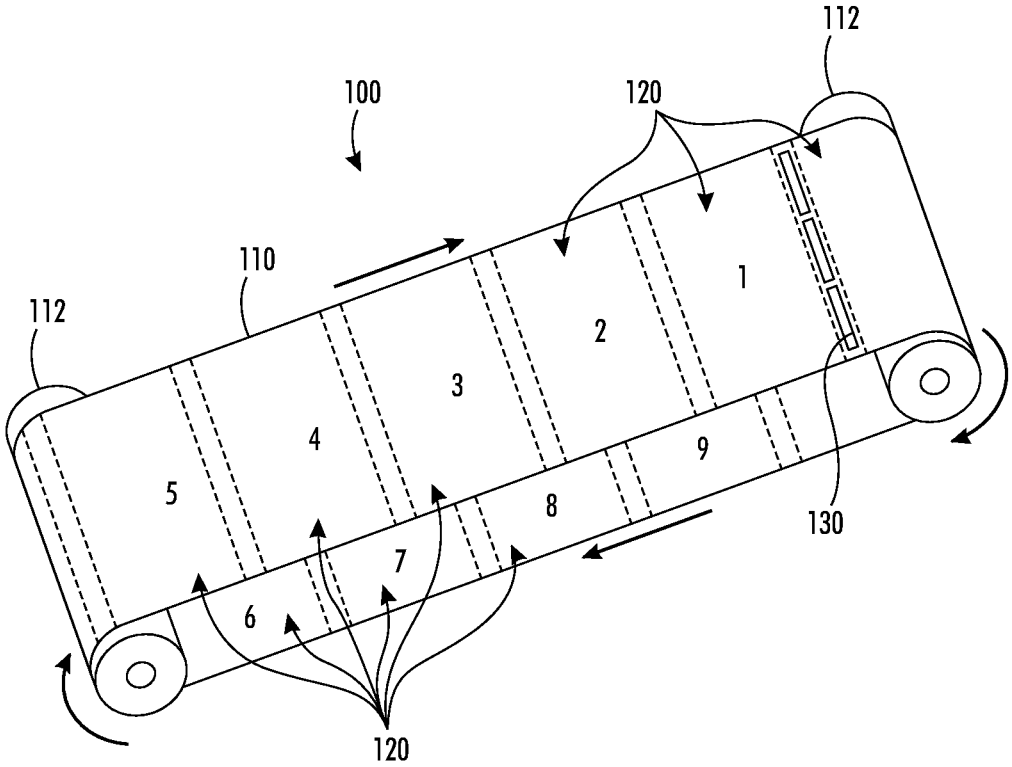
FIG. 1 shows an exemplary belt system that can be used in a printing system.

Exemplary embodiments are directed to calibration of a printing system to mitigate print imperfections resulting from color-to-color registration errors in the printing system. One source of color-to-color registration errors can be cyclical belt motion errors. Embodiments can implement a color-to-color registration setup that identifies panels on one or more belts and adjusts image disposition based on image placement correction factors for the panels. The printing system can use different calibration parameters for one or more of the panels to mitigate color-to-color registration errors on a per panel basis and/or based on unique panel combinations.

As used herein, a "printing system" refers to a device, machine, apparatus, and the like, for forming images on substrate media and a "multi-color printing system" refers to a printing system that uses more than one color (e.g., red, blue, green, black, cyan, magenta, yellow, clear, etc.) marking material to form an image on substrate media. A "multi-belt printing system" refers to a printing system that uses more than one belt to generate a print. A "direct marking printing system" refers to a printing system that disposes a marking material directly onto substrate media to generate prints. A "printing system" can encompasses any apparatus, such as a digital copier, bookmaking machine, facsimile machine, multi-function machine, etc. which performs a print outputting function. Some examples of printing systems include Direct-to-Paper, modular overprint press (MOP), ink jet, solid ink, as well as other printing systems.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as refers to herein can include one or more point sensors and/or array sensors for detecting and/or measuring characteristics or parameters in a printing system, such as a belt and or substrate media location, position, speed, orientation, process or cross-process position, and the like.

As used herein, "marking material" refers to a substance for printing images. Some examples of marking material include "ink" or "toner". While ink is generally stored in a liquid form and toner is generally stored in a solid form, ink and/or toner can be stored in various forms. For example, ink can be stored in a liquid form or a solid form.

As used herein, "process direction" refers to a direction in which substrate media is processed through a printing device and "cross-process direction" refers to a direction substantially perpendicular to the process direction.

As used herein, "downstream" refers to location of an object relative to a location of another object based on a direction in which a belt moves, wherein an object is downstream from another object when it is located away from the other object in the direction that the belt moves.

As used herein, "upstream" refers to location of an object relative to a location of another object based on a direction in which a belt moves, wherein an object is upstream from another object when it is located away from the other object in the direction that is opposite to the direction that the belt moves.

As used herein, "substrate media" refers to a tangible medium, such as paper (e.g, a sheet of paper, a long web of paper, a ream of paper, etc.), transparencies, parchment, film, fabric, plastic, or other substrates on which an image can be printed or disposed.

As used herein, an "image" refers to a visual representation, reproduction, or replica of something, such as a visual representation, reproduction, or replica of the contents of a computer file rendered visually on a belt or substrate media in a printing system. An image can include, but is not limited to: text; graphics; photographs; patterns; pictures; combinations of text, graphics, photographs, and patterns; and the like.

As used herein, a "belt" or "endless belt" refers to an "intermediate transfer belt" for transporting or carrying an image formed thereon for transfer to a substrate media and/or a "media transport belt" for transporting or carrying substrate media in a printing system.

As used herein, "rollers" refer to shafts, rods, cams, and the like that rotate about a center axis and cause a belt to rotate or revolve about the rollers.

As used herein, "rotate" or "revolve" refers to turning, spinning, or orbiting in a generally circular manner, elliptical manner, triangular manner, or manner, such as a belt turning, spinning, or orbiting about rollers in a printing system.

As used herein, "segmenting" refers to dividing, sectioning, partitioning, and the like, and may or may not refer to physically, visually, or otherwise segmenting something.

As used herein, a "panel" refers to a positions or locations on a belt at which an image is to be disposed and/or at which a substrate media is to be disposed. A location of the panels can be predefined or predetermined and/or can vary as the belt rotates. An "image panel" refers to a position or location on a belt at which an image is to be disposed and a "media panel" refers to a position or location at which a substrate media is to be disposed. Panels can be an approximate location along the belt for receiving an image or substrate media. In some instances, substrate media and/or images can be placed on the belt at a location between panels such that an extrapolation can be used when compensating for registration errors.

As used herein, "transporting" refers to carrying and/or moving an object or thing, such as an image or substrate media, from location to another location.

As used herein, "cyclical belt motion errors" refer to deviations in an expected, intended, desired, and/or planned motion of a belt that occur periodically as the belt rotates. For example, cyclical belt motion errors can be deviations of the belt in the process and cross process directions resulting, for example, from belt wandering, belt lag, belt tension, and the like. Cyclical belt motion errors can be caused by, for example, imperfections in the belts. The belt motion errors can vary as the belt rotates, but the belt motion errors corresponding to particular panels on the belt can be cyclical and can be correlated with respect to a substantially fixed reference location, such as an image transfer point. Cyclical belt motion errors corresponding to the particular panels on the belt are generally predictable so that each time the panels on the belt pass the substantially fixed reference location the belt motion error value associated with the panel can be estimated and/or determined. The particular locations on the belt can experience cyclical belt motion errors that differ from each other.

As used herein, the terms "register" and "registration" refer to determining the proper alignment of an image panel and/or a media panel with respect to a fixed reference.

As used herein, "registration error" refers to deviations in an expected, intended, desired, and/or planned position of a panel with respect to a substantially fixed reference location, and a "combined registration error" refers to a cumulative, overall, aggregate, unified, and the like, registration error of multiple panels from multiple belts with respect to one or more substantially fixed reference locations.

As used herein, "belt motion error values" refer to a numerical values associated with a belt motion error for a panel on a belt, which can be identified, measured, and/or determined as a belt revolves about rollers in a printing system.

As used herein, "misalignment" refers to a positional error of one thing or object with respect to another thing or object so that the things or objects do not align as intended, desired, expected, and the like.

As used herein, "color-to-color registration errors" refer to deviations from the expected, desired, intended, and/or planned location of a color marking material relative to the location of one or more other color marking material in an image.

As used herein, a "printing station" refers to a section in a printing system that disposes, transfers, forms, or otherwise generates an image on a substrate media.

As used herein, a "transfer point" refers to a location in printing system at which a marking material is transferred to a belt or substrate media.

As used herein, an "image marking unit" or "marking unit" refers to a unit for disposing, forming, transferring, or otherwise generating an image on a belt or substrate media.

As used herein, a "print head" refers to a type of marking unit that dispose or ejects ink onto a surface.

As used herein, a "controller" refers to a processing device for executing commands or instructions for controlling one or more components of a printing system and/or performing one or more processes implemented by the printing system.

As used herein, a "computer storage device" refers to a non-transient computer readable medium in which information is stored electronically.

As used herein, "compensating" refers to counteracting, offsetting, and/or opposing something by a contrary and/or opposing action, such as counteracting a cyclical belt motion error by applying an image place correction factor to an image marking unit.

As used herein, "correlation" refers to a relationship, association, and/or correspondence between two or more objects and things, such as a relationship between a panel on a belt and a belt motion error value and/or a location of a panel on one belt and a location of a corresponding panel on another belt.

As used herein, "corresponding" refers to related, associated, and/or correlated things or objects, such as corresponding panels on different belts.

As used herein, "individually" refers to separately and/or independently.

As used herein, "periodically" refers to recurring or repeating events at determinable intervals, such as recurring cyclical belt motion errors that occur on each revolution of the belt, every other revolution of the belt, every third revolution of the belt, and so on.

As used herein, "cyclical" refers to a periodic recurring or repeating event that occurs according to a cycle.

As used herein, "coinciding" refers to meeting, overlapping, occupying, aligning, and the like, a space by two or more objects or things. For example, when a media panel and an image panel coincide at a transfer point the media panel and the image panel meet, overlap, occupy, align, and the like, at the transfer point.

As used herein, "once around revolution" refers to a single revolution of a belt about rollers and a "once around period" refers to an amount of time it takes for a belt to complete a revolution. A "once around frequency" is the inverse of the once around period.

As used herein, "average" refers to a mathematically computation in which the average is the value of the quotient resulting from the division of a sum of a set of quantities by the number of quantities in the set.

As used herein, "placement" refers to disposing at a location or position.

As used herein, "image placement correction factors" refer to one or more parameters associated with one or more image marking units for controlling the location at which marking material is disposed on a belt and/or substrate media. Image placement correction factors can be numerical values specified to adjust the location at which marking material is disposed on a belt and/or substrate media and can be generated using the belt motion error values.

As used herein, "interact" refers to acting on and/or effecting one another.

As used herein, "lowest common multiple" refers to a mathematical computation resulting in the smallest quantity that is divisible by two or more given quantities without a remainder.

As used herein, a "panel combination" refers to a set of panels that coincide at least one transfer point and can include at least one media panel on a media transport belt and one image panel on a intermediate transfer belt, which coincide at a transfer point as the belts rotate.

As used herein, "unique panel combination" refers to a combination of panels that is different from remaining possible panel combinations.

As used herein, a "per-panel basis" refers to implementing, performing, and/or conducting for each panel.

As used herein, "calibrating" refers to adjusting, configuring, changing, modifying, and the like, to correct, eliminate, minimize, reduce, compensate, and/or counteract for deviations from the expected, desired, intended, and/or planned operation of a printing system.

As used herein, "test pattern" or "calibration pattern refers to a pattern printed to identify, detect, measure, and the like, registration errors in a printing system.

FIG. 1 shows an exemplary belt system 100 that can be used in a printing system. The belt system 100 can include an endless belt 110 supported in tension about rollers 112. The belt 110 can be an intermediate transfer belt, a media transport belt, a photoreceptor belt, and the like. For example, the belt 110 can be an intermediate transfer belt in a modular overprint press (MOP) printing system, a media transport belt, such as an electrostatic media transport belt, a vacuum media transport belt, and the like, in an MOP printing system or a direct-to-paper (DOP) printing system. One or more of the rollers 112 can be rotatably driven by a drive motor (not shown) to rotate the belt 110 about the rollers 112. Although the present embodiment includes two rollers 112, those skilled in the art will recognize that additional rollers may be used in the belt system 100.

The belt 110 can be segmented into panels 120. In some embodiments, the panels 120 can relate to locations where images are disposed when the belt 110 is an intermediate transfer belt. In some embodiments, the panels 120 can relate to locations where substrate media can be disposed when the belt 110 is a media transport belt. In this manner, images and/or substrate media can be disposed on the belt 110 at the panel locations. Using this approach, it can be determined where an image or substrate media is to be disposed on the belt 110 prior to disposing the image or substrate media thereon and the panels can be indexed based on their location on the belt 110 relative to the location of the other panels on the belt 110. In the present example, the belt 110 includes ten panels. In some embodiments, when the belt 110 is an intermediate transfer belt, the dimensions of the panels can depend on the size of the images to be disposed on the belt 110 and/or the size of the substrate media onto which the images are to be transferred. In some embodiments, when the belt 110 is a substrate media transport belt, the dimensions and/or spacing of the panels can depend on the size of the substrate media. The number of panels on the belt 110 can depend on the length of the belt 110 as well as the dimensions and/or spacing of the panels 120.

While panels 120 have been illustrated using dashed lines, those skilled in the art will recognize that the panels 120 may or may not be visibly or otherwise demarcated on the belt 110. In some embodiments, the belt 110 can include a start marker 130 that can be detected by one or more sensors in the printing system to determine when the belt 110 has made one revolution. In some embodiments, the panels 120 can be distinguished and/or indexed based on their location on the belt 110 relative to the start marker 130.

During operation of the belt 110, cyclical belt motion errors can occur as the belt 110 revolves about the rollers 112. For example, the belt 110 can wander on the rollers 112 such that the lateral position of the belt 110 shifts in the cross process direction as the belt 110 rotates about the rollers 112. The cyclical belt motion errors can vary as the belt 110 rotates, however the cyclical belt motion errors corresponding to particular panels on the belt 110 can be correlated with respect to a substantially fixed reference location so that the cyclical belt motion errors corresponding the particular panels on the belt 110 are generally predictable each time the panels on the belt pass the substantially fixed reference location. These cyclical belt motion errors can affect the location at which marking material is disposed on the belt 110 when the belt is an intermediate transfer belt and/or can affect the location at which substrate media is disposed on the belt when the belt is a substrate media transport belt. As a result of the cyclical belt motion errors, the position of the marking material and/or substrate media on the belt 110 can differ from an expected or intended position, which can cause printing imperfections during the printing process due to the deviation in the belt's position from the expected position. These printing imperfections can reduce the quality of prints generated using the printing process.

The cyclical belt motion errors induced in the process and/or cross-process directions can be synchronized with a once-around belt revolution such that at least a portion of these cyclical belt motion errors are substantially repeatable on each revolution of the belt 110 such that the cyclical belt motion errors are a function of panel locations on the belt 110 as the belt 110 revolves about the rollers 112. That is, cyclical belt motion errors can occur at the once-around frequency of the belts, and their corresponding higher harmonic frequencies. In this manner, cyclical belt motion errors values can be associated with particular panels 120 on the belt 110. For example, first belt motion error values that repeatedly occur for each revolution of the belt 110 can be identified for a first one of the panels 120, second belt motion error values that repeatedly occur for each revolution of the belt 110 can be identified for a second one of the panels 120, and so on. Cyclical belt motion errors can be caused by, for example, conicity, stress and strain variations on the belts, thickness variations of the belts, seam zone imperfections of the belts, and the like.

In exemplary embodiments, the cyclical belt motion errors associated with one or more belts in a printing system can be mitigated using a calibration process. The calibration process can use printed test patterns that can be analyzed to determine error values associated with the cyclical belt motion errors on a per panel basis. For example, using the test patterns, it can be determined that the test pattern, a portion of the test pattern, one or more colors of the test pattern, and the like, have shifted by a measurable distance from the location at which the test pattern, portion of the test pattern, one or more colors of the test pattern, and the like, were intended or expected to be disposed or by a measureable distance relative to one or more colors being disposed to form the image or partial image. The difference between the actual location and the intended location and/or the relative difference between the different marking materials represents error values. In some embodiments, error values can be associated with particular panels and/or can be associated with particular marking material colors. Image placement correction factors can be calculated for each panel based on the error values and the printing system can be configured using the image placement correction factors to mitigate the affects of the once around belt motion errors on a per panel basis. In this manner, each panel can have its own image placement correction factors to counteract the error values on a per panel basis.

For embodiments in which multiple belts are implemented in a printing system there can be belt-to-belt interactions, which can create complex belt motion errors attributed to the one or more belts. For example, a modular overprint press (MOP) printing system can include a media transport belt for transporting substrate media in the process direction and can include one or more intermediate transfer belts on which marking material forming an image or partial image can be disposed for subsequent transfer to the substrate media being transported by the media transport belt. In these embodiments, each belt can have cyclical belt motion errors that can affect the print quality of the print system and/or there can be belt-to-belt interactions that affect the print quality. The cyclical belt motion errors for each belt and/or the interaction between the belts can cumulatively or otherwise affect the print quality and can be manifested as color-to-color registration errors in the prints. The number of panels on each of the belts can be used to determine the number of image placement correction factor sets are used to mitigate the once around belt errors. As one example, the number of image placement correction factor sets can be equal to the lowest common multiple of panels between the belts.

Figure 2:
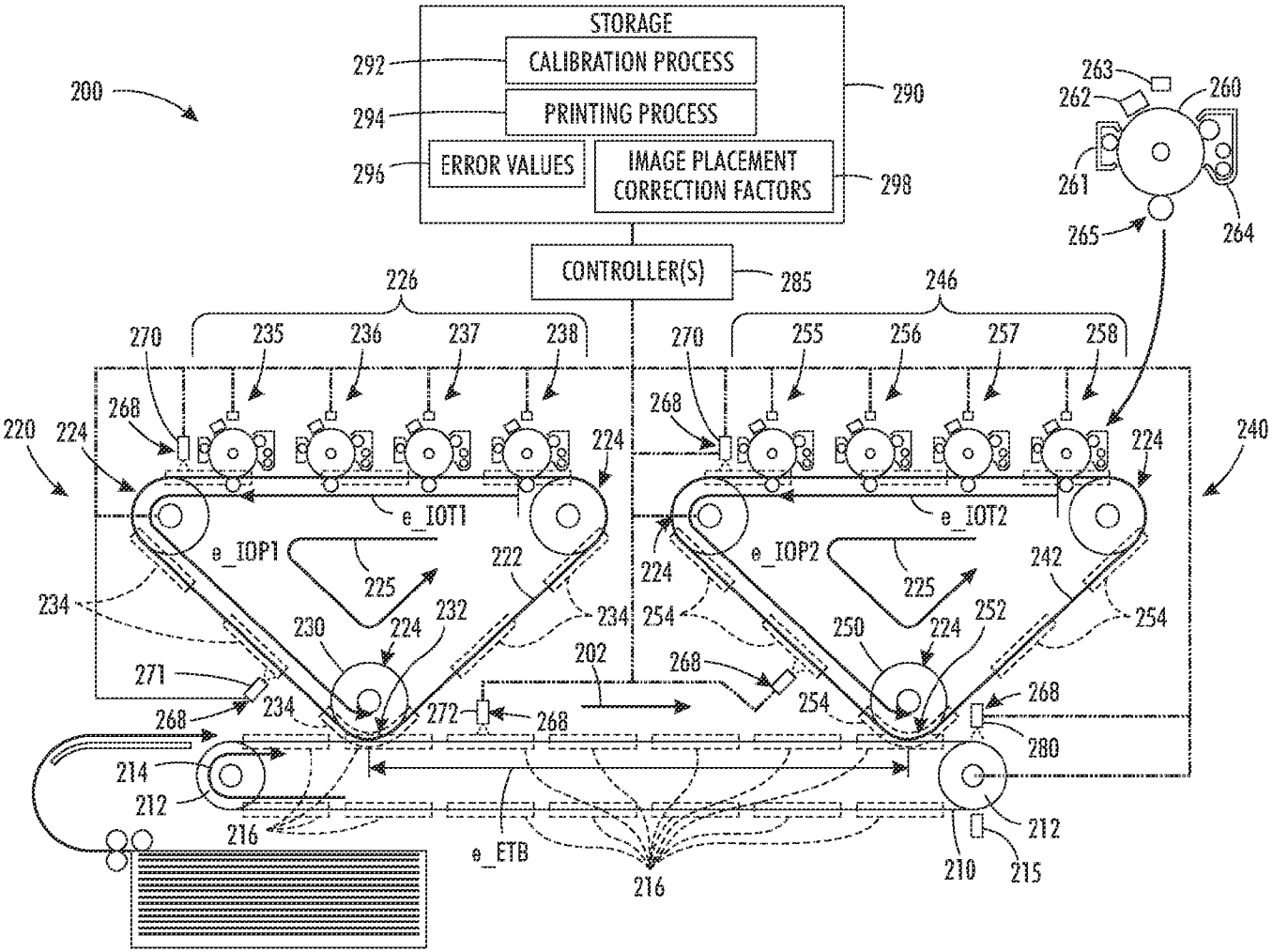
FIG. 2 shows an exemplary multi-color printing system having an exemplary modular overprint press (MOP) belt arrangement.

FIG. 2 shows an exemplary eight-color printer 200, such as an eight color xerographic printer, having an exemplary modular overprint press (MOP) belt arrangement with a single substrate media path. The printer 200 includes a media transport belt 210, a printing station 220, a printing station 240, one or more controllers 285, and tangible computer readable storage medium 290. Although the exemplary embodiment is illustrative of an eight-color printer having two printing station and one media transport belt, those skilled in the art will recognize that other embodiments can have more or fewer marking material colors can be implemented and/or that other embodiments can include more or fewer printing stations. As one example, a four-color MOP printer can be implemented with a single printing station, such as the MOP printer described in U.S. Pat. No. 7,586,512 issued on Sep. 8, 2009, the disclosure of which is incorporated herein by reference in its entirety.

The media transport belt 210 can be used to transport substrate media in a process direction 202 past the printing stations 220 and 240. The media transport belt 210 is supported at a predetermined tension about rollers 212, one or more of which can be rotatably driven by one or more drive motors (not shown) to rotate the media transport belt 210. In the present embodiment, the media transport belt 210 rotates in a clockwise direction indicated by arrow 214. A cleaning unit 215 can be positioned in proximity to the transport belt 210 to clean the belt 210 as it rotates. For example, the cleaning unit can remove marking material disposed on the transport belt 210. The media transport belt 210 can be segmented into media panels 216. The number of media panels 216 on the media transport belt 210 can be based on the length of the media transport belt 210 and the dimensions and/or spacing of the substrate media being transported by the media transport belt 210. In the present example, the media transport belt 210 is segmented into sixteen media panels 216. The media transport belt 210 can exhibit cyclical belt motion errors that correspond to the once around frequency of the media transport belt 210. Although the present example includes sixteen media panels, those skilled in the art will recognize that the media transport belt 210 can be segmented into more or fewer media panels and/or that the number of media panels can change when the size of the substrate media transported by the media transport belt 210 changes.

In some embodiments, the media transport belt 210 can be an electrostatic transport belt that uses electrostatic charge to attract the substrate media to the electrostatic transport belt. The electrostatic charge causes the substrate media to "stick" to the media transport belt to inhibit movement of the substrate media during the printing process. While the substrate media is on the electrostatic transport belt, the substrate media typically does not shift unless a force is applied to the substrate media overcoming the force of attraction resulting from the electrostatic charge and/or the electrostatic charge is removed. Thus, the substrate media typically does not shift while it is disposed on the electrostatic transport belt.

In some embodiments, the media transport belt 210 can be a vacuum transport belt that uses suction to hold the substrate media in place on the vacuum transport belt. The suction causes the substrate media to "stick" to the media transport belt to inhibit movement of the substrate media during the printing process. While the substrate media is on the vacuum transport belt, the substrate media typically does not shift unless a force is applied to the substrate media overcoming the force of attraction resulting from the suction and/or the suction is removed. Thus, the substrate media typically does not shift while it is disposed on the vacuum transport belt.

The printing stations 220 and 240 can include an intermediate transfer belt 222 and 242, respectively, supported by rollers 224; sets 226 and 246 of image marking units for disposing marking material on the intermediate transfer belts 222 and 242, respectively, to form an image or a partial image; and sensors 268 for sensing various parameters associated with the printing process. The intermediate transfer belts 222 and 242 can be used as an intermediate surface on which images or partial images are disposed before being transferred to the substrate media at transfer point 232 and 252, respectively. The intermediate transfer belts 222 and 242 can be endless belts supported with a predetermined tension about the rollers 224. One or more of the rollers 224 can be rotatable driven so that intermediate transfer belt 222 and/or the intermediate transfer belt 242 rotate in an opposite direction of the media transport belt 210. For example, in the present embodiment, the intermediate transfer belts 222 and 242 can rotate in a counterclockwise direction indicated by arrow 225.

In the present embodiment, the intermediate transfer belts 222 and 242 are supported by three rollers, where one of the rollers supporting intermediate transfer belt 222 is a transfer roller 230 that facilitates engagement of the intermediate transfer belt 222 with media transport belt 210 at the transfer point 232 and one of the rollers 224 supporting intermediate transfer belt 242 is a transfer roller 250 that facilitates engagement of the intermediate transfer belt 242 with media transport belt 210 at the transfer point 252. The pressure at which the intermediate transfer belts 222 and 242 engage the media transport belt 210 can be adjusted by controlling the position of the transfer rollers 230 and 250 with respect to the media transport belt 210.

As one example, the transfer rollers 230 and 250 can be shifted towards the media transport belt 210 to increase the pressure with which the intermediate transfer belts 222 and 242 engage the media transport belt 210. As another example, the transfer rollers 230 and 250 can be shifted away from the mediate transport belt 210 to decrease the pressure with which the intermediate transfer belts 222 and 242 engage the media transport belt 210. In some embodiments, the position of the transfer rollers 230 and 250 are adjusted based on a thickness and/or weight of the substrate media onto which an image is to be transferred from the intermediate transfer belts 222 and 242. The pressure with which the intermediate transfer belts 222 and 242 engage the media transport belt 210 can affect the belt-to-belt interactions and/or can contribute to cyclical belt motion errors such that different settings of the transfer rollers 230 and 250 can result in different error values. In some embodiments, a separate set of image placement correction factors can be generated for the different positions of the transfer rollers 230 and 250. The position of the transfer rollers can be specified as a distance from a default position of the transfer roller. For example, the default position of the transfer roller can be zero millimeters (0 mm), a position of +1 mm refers to shifting the transfer roller 1 mm towards the media transfer belt 210, and a position of −1 mm refers to shifting the transfer roller 1 mm away from the media transfer belt 210.

The intermediate transfer belts 222 and 242 can be segmented into image panels 234 and 254, respectively. The number of image panels 234 and 254 on the intermediate transfer belts 222 and 242 can depend on the length of the intermediate transfer belts 222 and 242, the size of the image being disposed on the intermediate transfer belts 222 and 242, the size of the substrate media to which the image is to be transferred, the spacing between the image panels, and the like. The images disposed on the intermediate transport belts 222 and 242 can be transferred to substrate media disposed on the media transport belt 210 at the transfer point 232 and 252. In the present example, the intermediate transfer belts 222 and 242 are each segmented into eight media panels. The intermediate transfer belts 222 and 242 can exhibit cyclical belt motion errors that correspond to the once around frequency of the belt 210 and can be correlated to image panel locations on the belt 210.

Although the present example includes eight image panels, those skilled in the art will recognize that the intermediate transfer belts 222 and 242 can be segmented into more or fewer image panels. In some embodiments the intermediate transfer belt 222 can have a different number of image panels than the image transfer belt 242. In some embodiments, the length of the intermediate transfer belt 222 can be substantially identical to the length of the intermediate transfer belt 242. In some embodiments, the length of the intermediate transfer belt 222 can be different from the length of the intermediate transfer belt 242.

In some embodiments, the length of the media transport belt can be a multiple, integer, fraction, or otherwise, of the length of the intermediate belts. For example, in one embodiment, the media transport belt can be twice the length of the intermediate transfer belts 222 and 242 such that the intermediate transfer belts 222 and 242 complete two revolutions for every revolution of the media transport belt. The intermediate transfer belts can be synchronized with the media transport belt such that the image panels coincide with the media panels at the transfer points as the belts rotate to form panel combinations. In some embodiments, the lengths of each of the belts can be different from each other. For example, the media transport belt 210 can be three times the length of the intermediate transfer belt 222 and can be twice the length of the intermediate transfer belt 242. Although the lengths of the belts have been illustrated using integer multiples, those skilled in the art will recognize that other arrangements are possible. For example, the intermediate transfer belts can be three-fourths the length of the media transport belt 210 such that the media transport belt completes three revolutions for every two revolutions of the intermediate transfer belts 222 and 242.

Likewise, in some embodiments the number of media panels can be a multiple, integer, fraction, or otherwise, of the number of image panels. For example, the media transport belt can include twice as many media panels as the intermediate transfer belts can include image panels such that each media panel corresponds to two image panels per intermediate transfer belt. As one example, the media transport belt 210 can include sixteen media panels and the intermediate transfer belts 222 and 242 can each include eight image panels such that the lowest common multiple of panels is sixteen.

To counteract color-to-color registration errors for each panel combination in a system where a lowest common multiple of panels is sixteen, the printing system can include at least sixteen image placement correction factor for each of the possible panel combination for each position of the transfer rollers so that the printing system covers the possible panel combinations for each of the possible transfer roller settings to counteract the cyclical belt motion errors.

In some embodiments, the number of panels on each of the belts can be different from each other. For example, the media transport belt 210 can have three times the panels as the intermediate transfer belt 222 and can have twice the panels as the intermediate transfer belt 242. Although the number of panels on the belts have been illustrated using integer multiples, those skilled in the art will recognize that other arrangements are possible. For example, the media transport belt 210 can include fifteen media panels and the intermediate transfer belts can include eight image panels such that the lowest common multiple of the panels is one hundred twenty (120). In this example, one hundred twenty (120) sets of image placement correction factors can be used to counteract color-to-color registration errors on a per panel basis for a given position of the transfer rollers.

The cyclical belt motion errors can vary as the belts 210, 222, and 242 rotate. The cyclical belt motion errors corresponding to particular ones of the panels 216, 234, and/or 254 on the belts 210, 222, and 242, respectively, can be correlated with respect to one or more substantially fixed reference locations so that the cyclical belt motion errors corresponding the particular ones of the media panels 216 on the belt 210 are generally predictable each time the panels on the belt pass the transfer points 232 and/or 252. For example, the cyclical belt motion errors corresponding to the media panels 216 can be correlated to the transfer points 232 and 252, the cyclical belt motion errors corresponding to the intermediate transfer belt 222 can be correlated to the transfer point 232 and/or the location of the marking units 226, and the cyclical belt motion errors corresponding to the intermediate transfer belt 242 can be correlated to the transfer point 252 and/or the marking units 246. In this manner, the belts 210, 222, and 242 in the printing system 200 can demonstrate substantially repeatable once around, per revolution cyclical belt motion errors.

The intermediate transfer belts 222 and 242 can interact with the media transport belt 210 at the transfer points 232 and 252, respectively, which can result in a combined registration error attributed to the cyclical belt motion errors associated with the belts 210, 222, and 242. The interactions between the belts can also introduce other printing errors that can be manifested in the combined registration error. Thus, the printing error can vary depending on the transfer roller setting of the printing station 220 and/or the printing station 240. The cumulative error can be manifested as imperfections in printouts from the printing system and can degrade the quality of printouts from the printing system.

The sets 226 and 246 of image marking units can be positioned along the intermediate transfer belts 222 and 242, respectively, and are configured to dispose marking material on the intermediate transfer belts 222 and 242 to form an image or a partial image on the intermediate transfer belts 222 and 242. In the present embodiment, the set 226 of image marking units in the printing station 220 can include four image marking units 235-238 disposed in order along a portion of the intermediate transfer belt 222 and the set 246 of image marking units can include four image marking units 255-258.

In some embodiments, each of the image marking units 235-238 dispose a different color marking material on the intermediate transfer belt 222. For example, the image marking unit 235 can dispose black marking material (K) on the intermediate transfer belt 222, the image marking unit 236 can dispose cyan marking material (C) on the intermediate transfer belt 222, the image marking unit 237 can dispose yellow marking material (Y) on the intermediate transfer belt 222, and the image marking units 238 can dispose magenta marking material (M) on the intermediate transfer belt 222. In some embodiments, each of the image marking units 255-258 dispose a different color marking material on the intermediate transfer belt 242. For example, the image marking unit 255 can dispose red marking material (R) on the intermediate transfer belt 242, the image marking unit 256 can dispose green marking material (G) on the intermediate transfer belt 242, the image marking unit 257 can dispose blue marking material (B) on the intermediate transfer belt 242, and the image marking units 258 can dispose clear marking material on the intermediate transfer belt 242. In this manner, the printing system 200 can form images using eight different colors divided between two printing stations. Although each of the image marking units can be implemented with different color marking material, those skilled in the art will recognize that some, all, or none, of the image marking units can be implemented with an identical color marking material. Furthermore, those skilled in the art will recognize that the printing system can include more or fewer printing station and that each printing station can include more or fewer image marking units.

In some embodiments, each of the image marking units 235-238 and 255-258 can include a photoconductor drum 260, a cleaner 261, an erase lamp (not shown), a charger 262, a laser scanner 263, a developing unit 264, and a first transfer roll 265, each of which can be disposed around each of the photoconductor drums 260 along the rotational direction of the drum (clockwise direction in FIG. 2). The cleaner 261 removes marking material remaining on the photoconductor drum 260 from a previous image to prepare the drum 260 for the next image. The erase lamp destaticizes the drum 260 to remove any remaining charge on the drum 260 that is associated with an image previously disposed on the drum 260. The charger 262 electrically charges the drum so that the drum can receive a latent image from the laser scanner 263. The laser scanner 263 irradiates light on the charged drum 260 to form a latent image on the drum 260. The developing unit 264 forms marking material images on the drum, which are transferred to the intermediate transfer belts using transfer rollers 265.

The sensors 268 can sense various parameters associated with the printing process. In some embodiments, some of the sensors 268 can be mark-on-belt (MOB) sensors. In some embodiments, at least some of the sensors 268 can sense the presence of substrate media on the media transport belt 210, some of the sensors 268 can sense the presence of an image on the intermediate transfer belt 222 and/or the intermediate transfer belt 242, some of the sensors 268 can be used to detect color registration errors of images disposed on the intermediate transfer belt 222, the intermediate transfer belt 242, the media transport belt 210 and/or on substrate media being transported by media transport belt 210.

In the present embodiment, each of the printing stations 220 and 240 can include a sensor 270, a sensor 271, and a sensor 272. The sensors 270 can be positioned to sense an image or partial image that has been disposed on the intermediate transfer belts 222 and 242. For example, one of the sensors 270 can be disposed next to, and downstream of, the image marking unit 235 for the printing station 220 and one of the sensors 270 can be positioned next to, and downstream of, the image marking unit 255 for the printing station 240. The sensors 271 can be positioned to sense an image disposed on the intermediate transfer belts 222 and 242 near, and upstream of, the transfer points 232 and 252 such that the sensors 271 can detect the image or partial image on the intermediate transfer belts 222 and 242 prior to transfer of the image or partial images to substrate media. The sensors 272 can be positioned to sense an image that has been transferred to substrate media and can be located down stream of the transfer point 232 for the printing station 220 and can be located down stream of the transfer point 252 for the printing station 240.

Color registration errors e_IOT1 can occur during the formation of an image or partial image by the image marking units 235-238. In some embodiments the sensor 270 can detect these color registration errors. Color registration errors e_IOP1 can occur during transport of an image from image marking unit 235 to the transfer point 232 due to a misalignment of the intermediate transfer belt 222 as the belt 222 revolves around the rollers. In some embodiments, the sensor 271 can detect these color registration errors. For embodiments implemented as a single intermediate transfer belt tandem printer the color registration errors e_IOT1 can manifested as an image-to-paper registration error, as opposed additional color-to-color registration error since the colors (e.g., yellow, magenta, cyan, and black) move by the same amount during the e_IOP1 transport portion.

Color registration errors e_ETB can occur during the transport of substrate media from the transfer point 232 to the transfer point 252 due to misalignment of the media transport belt 210. In some embodiments, the sensors 272 can be used to detect these color registration errors. Color registration errors e_IOT2 can occur during the formation of an image or partial image on the intermediate transfer belt 242 by the image marking units 255-258 due to a misalignment of belt 242. In some embodiments the sensor 270 can detect these color registration errors. Color registration errors e_IOP2 can occur during transport of an image or partial image from the image marking unit 255 to the transfer point 252 due to misalignment of the intermediate transfer belt 242 as the belt 242 revolves around the rollers. In some embodiments, the sensor 271 can detect these color registration errors.

In some embodiments, the printing system 200 can include one or more sensors 280 for detecting a reference point on the belts to determine a start location of the belts for identifying when the belts complete a revolution. Using this approach, the printing system 200 can track and/or index the panels based on the location of the panels with respect to the start marker and can facilitate mitigation of color-to-color registration errors on a per panel basis.

One or more of the controllers 285 can be implemented to facilitate performance of calibration and printing processes by the printing system 200. One or more of the controllers 285 can be in communication with drive motors (not shown) of the rollers 212 and 224 to control the speed at which the belts 210, 222, and/or 242 rotate; the position of the transfer rollers 230 and 250; the sensors 268 to receive and process sensor signals; the image marking units 235-238 and 255-258 to control image deposition; and a non-transitory computer readable storage medium 290. The storage medium 290 can store instructions for executing the calibration process 292 and the printing process 294. The storage medium 290 can also store error values 296 and image placement correction factors 298 for the panels for one or more configurations of the printing system 200. The storage medium 290 can store instructions that when executed cause the printing system to implement the calibration process 292 and/or the printing process 294. Some examples of non-transitory computer readable storage mediums can include a floppy drive, hard drive, compact disc, tape drive, Flash drive, optical drive, read only memory (ROM), random access memory (RAM), and the like.

In an exemplary calibration process, color-to-color registration errors can be detected using test patterns that can be printed by the printing system 200. The image marking units 235-238 of the printing station 220 can form a partial test pattern on the intermediate transfer belt 222 for one or more of the image panels on the belt 222. In some embodiments, the test patterns disposed on the intermediate transfer belt 222 can be sensed by the sensor 270 and/or sensor 271 to detect the color-to-color registration errors attributed to the intermediate transfer belt 222 prior to transferring the test patterns to substrate media being transported by the media transport belt 210. The test patterns can be formed to facilitate detection of deviations in marking material deposition from an expected location and/or can be formed to facilitate detection of the relative marking material-to-marking material (color-to-color) deposition so that, for example, the location in which one color marking material is disposed relative to another color marking material can be detected.

The test patterns can be transferred, at the transfer point 232, from the image panels on the intermediate transfer belt 222 to substrate media positioned on and being transported by the medial panels of the media transport belt 210. In some embodiments, the test patterns transferred to the substrate media can be sensed by the sensor 272 downstream of the printing station 220 to detect the color-to-color registration errors prior to the substrate media arriving at the second printing station 240.

The image marking units 255-258 of the printing station 240 can form a partial test pattern on the intermediate transfer belt 242 for one or more of the image panels on the belt 242. In some embodiments, the test patterns disposed on the intermediate transfer belt 242 can be sensed by the sensor 270 and/or sensor 271 to detect the color-to-color registration errors attributed to the intermediate transfer belt 242 prior to transferring the test patterns to substrate media being transported by the media transport belt 210. The test patterns can be formed to facilitate detection of deviations in marking material deposition from the image marking units from an expected location and/or can be formed to facilitate detection of the relative marking material-to-marking material (color-to-color) deposition so that, for example, the location in which one color marking material is disposed relative to another color marking material can be detected.

The test patterns can be transferred, at the transfer point 252, from the image panels on the intermediate transfer belt 242 to substrate media positioned and being transported on the medial panels by the media transport belt 210. The transfer of the test patterns disposed on the intermediate transfer belt 242 to the substrate form complete test patterns of the substrate media. In some embodiments, the test patterns transferred to the substrate media can be sensed by the sensor 272 downstream of the printing station 220 to detect the color-to-color registration errors prior to the substrate media arriving at the second printing station 240.

In some embodiments, test patterns printed on substrate media can be analyzed to detect color-to-color registration errors in the printing system on a per panel basis and/or on a unique panel combination basis, which can be attributed to cyclical belt motion errors, as well as other errors introducing print imperfections. For example, the test patterns can be analyzed using one or more controllers in communication with the sensors in the printing system, a scanner, and/or other devices. Deviations in the relative marking material deposition on the substrate media from the expected and/or desired locations can be caused by cyclical belt motion errors and interactions. Error values can be measured using an expected and actual location of the marking material on the substrate and/or an actual location of the marking material on the substrate relative to the actual location of other marking material on the substrate.

In some embodiments, at least one test pattern can be printed for each panel and/or panel combination and error values can be calculated for each panel and/or panel combination. In some embodiments, multiple test patterns can be printed for each panel and/or panel combination and average error values can be calculated for each panel. Using the error values identified by the test patterns, image placement correction factors can be generated on a per panel basis and/or for each unique panel combination. The image placement correction factors can be stored in a correction table in the storage for subsequent retrieval and use in the calibration and/or printing process.

By printing calibration patterns or test patterns on the belts (e.g., the intermediate transfer belts and/or the media transport belt) and using mark-on-belt (MOB) sensors or scanning prints of the test patterns to evaluate color-to-color registration errors in the prints, a correction table of image placement correction factors can be built that can remove the DC component associated with belt motion errors caused by the media transport belt and/or one or more of the intermediate transfer belts for the panels, since the cyclical belt motion error have been shown to be repeatable on the belts for a revolution of the belt. This correction strategy can remove or reduce color-to-color registration errors in the printing system.

In an exemplary printing process, the printing system is configured for a printing job. For example, the size of the substrate media, the position of the transfer rollers, and one or more images are specified. The number and location of panels on the belts can be determined based on the configuration for the print job. To begin, substrate media, such as sheets of paper, are transported by the printing stations 220 and 240 by the media transport belt 210. One or more of the controllers retrieve the image placement correction factors from storage for the panels for a given position of the transfer rollers and configures the image marking units with the image placement correction factors so that color-to-color registration errors can be mitigated on a per panel basis and/or for each unique panel combination during the printing operation. The image placement correction factors can cause the image marking units to adjust the location at which the image marking units dispose marking material on the intermediate transfer belt 222 to counteract color-to-color registration errors on a per panel basis and/or for each unique panel combination.

The substrate media is positioned on one of the media panels of the media transport belt 210. The media transport belt transports the substrate media past the printing station 220, which transfers a first partial image to the substrate media from the intermediate transfer belt 222. The partial image is disposed on one of the image panels of the intermediate transfer belt 222 by the image marking units 235-238 prior to the substrate media reaching the transfer point 232. The image panel on which the partial image is disposed can correspond to the media panel on which the substrate media is disposed such that the media panel and the image panel arrive at the transfer point at substantially the same time to effectuate a transfer of the partial image from the intermediate transfer belt to the substrate media.

Once the substrate media receives the partial image from the intermediate transfer belt 222, the image panel location is cleaned and prepared for receipt of another partial image and the substrate media continues to be transported in the process direction towards the printing station 240. A second partial image is disposed at an image panel on the intermediate transfer belt 242 that corresponds to the media panel on which the substrate media is disposed such that the media panel and the image panel arrive at the transfer point 252 at substantially the same time. The transport media belt 210 transports the substrate media past the transfer point 252, at which point the second partial image is transferred to the substrate media from the intermediate transfer belt 242 to form a final image.

Figure 3:
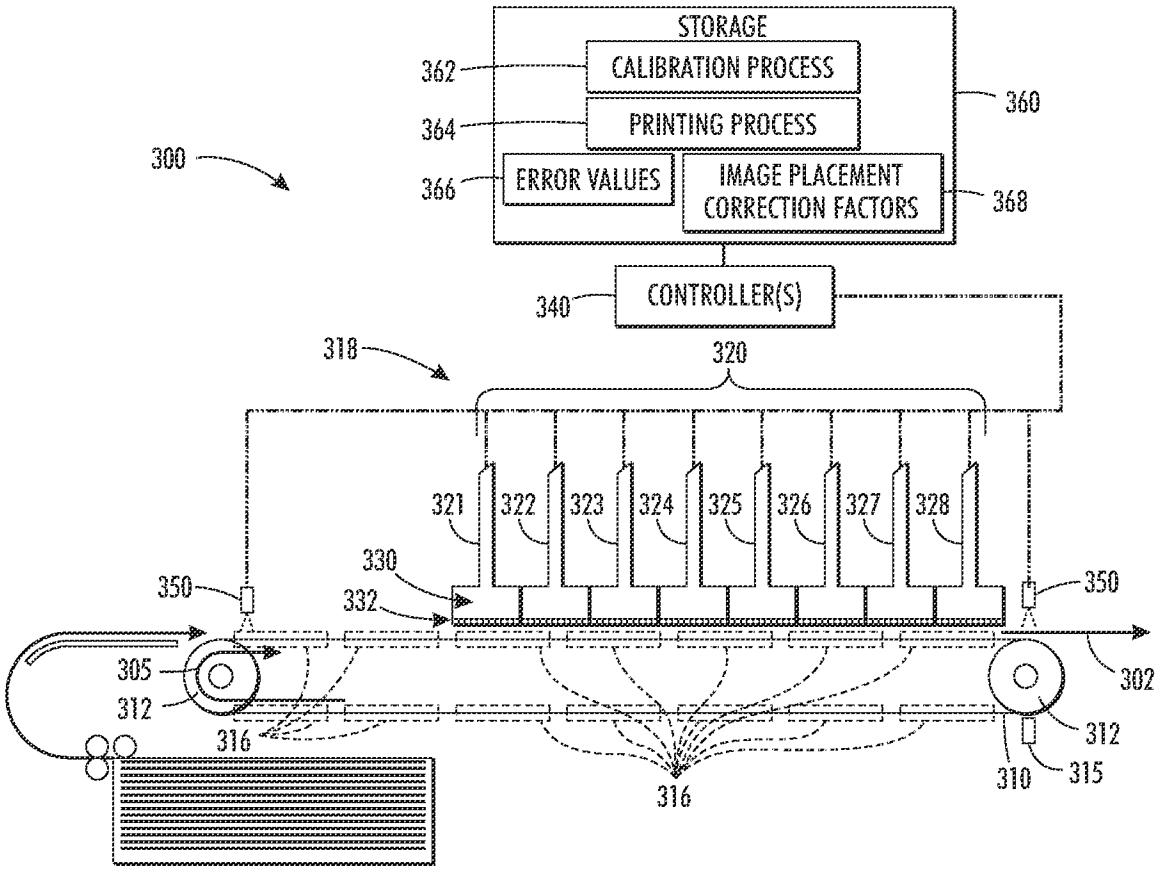
FIG. 3 is an exemplary multi-color printing system implemented as a Direct-to-Paper (DOP) or ink jet printing system.

FIG. 3 is an exemplary Direct-to-Paper (DOP) or ink jet printing system 300 (hereinafter "printing system 300") having a media transport belt 310, a printing station 318 including a set 320 of image marking units, one or more controllers 340, sensors 350, and a non-transitory computer readable storage medium 360. The media transport belt 310 can be implemented in a like manner as the media transport belt 210 of FIG. 2. The media transport belt 310 can be supported at a predetermined tension about rollers 312, one or more of which can be rotatably driven by one or more drive motors (not shown) to rotate the media transport belt 310. In the present embodiment, the media transport belt 310 rotates in a clockwise direction indicated by arrow 305. A cleaning unit 315 can be positioned in proximity to the transport belt 310 to clean the belt 310 as it rotates. For example, the cleaning unit can remove marking material disposed on the transport belt 310. The media transport belt 310 can be segmented into media panels 316 and can include a belt start marker that can be used to determine when the media transport belt 310 has completed a revolution. The media transport belt 310 can rotate in a clockwise direction illustrated by arrow 305. In the present embodiment, the media transport belt 310 includes ten media panels, although those skilled in the art will recognize the media transport belt 310 can include more or fewer media panels and that substrate media can be placed anywhere along the circumference of the belt. Furthermore, one skilled in the art will recognize that the term "panels" in this embodiment is intended to indicate an approximate location along the belt and is not intended to limit the location at which substrate media can be disposed to rigid, static, or specific pre-defined locations on the belt. For example, the corrections used for substrate media placed on the belt at a location between "panels" 2 and 3 could be extrapolated to best correct for the errors seen at that location on the belt.

In the present embodiment, the set 320 of image marking units in the printing station 318 includes image marking units 321-328. The image marking units 321-328 can be formed as page-width-sized print heads 330 that dispose marking material directly on a substrate media as the substrate media passes by the image marking units 321-328. Each of the marking units 321-328 can dispose a different color marking material on the substrate media such that the printing system 300 can be an eight-color printer. The print heads can include print nozzles 332 distributed across a bottom of the print heads and through which marking material can be ejected to print an image on substrate media. The print heads can be controlled to eject marking material from selected print nozzle based on a location on the substrate media at which marking material is to be disposed.

Although the present embodiment includes eight image marking units, those skilled in the art will recognize that the printing system can be implemented with more or fewer image marking units and that some, all, or none of the image marking units can be implemented to use the same colors. Furthermore, while the print heads in the present embodiment are page-width sized print heads, those skilled in the art will recognize that the size of the print heads can be smaller or larger than a page width of the substrate media.

Cyclical belt motions errors of the media transport belt 310 as substrate media passes from image marking unit to image marking unit can result in color-to-color registration errors. The cyclical belt motion errors can vary as the belt 310 rotates. The cyclical belt motion errors corresponding to particular ones of the media panels 316 on the belts 310 can be correlated with respect to one or more of the marking units 321-328 so that the cyclical belt motion errors corresponding the particular ones of the media panels 316 on the belt 310 are generally predictable each time the panels 316 on the belt 310 pass one or more of the marking units 321-328. The cyclical belt motion errors associated with the rotation of the belt 310 can correlate to a once around revolution of the belt 310. In this manner, error values for the cyclical belt motion errors can be identified on a per-panel basis and the printing system 300 can counteract the cyclical belt motion errors by calibrating the image marking units on a per-panel basis.

The one or more of the controllers 340 can be implemented to facilitate performance of calibration and printing processes by the printing system 300. One or more of the controllers 340 can be in communication with drive motors (not shown) of the rollers 312 to control the speed at which the belt 310 rotates; the sensors 350 to receive and process sensor signals; the image marking units 321-328 to control image deposition; and the non-transitory computer readable storage medium 360. The storage medium 360 can store instructions for executing the calibration process 362 and the printing process 364. The storage medium 360 can also store error values 366 and image placement correction factors 368 for the media panels 316 for one or more configurations of the printing system 300. The storage medium 360 can store instructions that when executed cause the printing system to implement the calibration process 362 and/or the printing process 364. Some examples of non-transitory computer readable storage mediums can include a floppy drive, hard drive, compact disc, tape drive, Flash drive, optical drive, read only memory (ROM), random access memory (RAM), and the like.

In an exemplary calibration process, color-to-color registration errors can be detected using test patterns that can be printed by the printing system 300. For example, the test patterns can be analyzed using one or more controllers in communication with the sensors in the printing system, a scanner, and/or other devices. The image marking units 321-328 of the printing station 318 can form a test pattern on substrate media positioned on the medial panels 316 of the media transport belt 310. In some embodiments, the test patterns disposed on the substrate media can be sensed by one of the sensors 350 positioned downstream of the printing station 318 to detect the color-to-color registration errors.

In some embodiments, each of the image marking units 321-328 of the printing station 318 can form a partial test pattern on the substrate media being transported on the media panels 316 of the belt 310 such that a complete test pattern can be formed using the partial test patterns. The test patterns can be formed to facilitate detection deviations in marking material deposition from the image marking units from an expected location and/or can be formed to facilitate detection of the relative marking material-to marking material (color-to-color) deposition so that, for example, the location in which one color marking material is disposed relative to another color marking material can be detected.

In some embodiments, test patterns printed on substrate media can be analyzed to detect color-to-color registration errors in the printing system 300 on a per media panel basis, which can be attributed to cyclical belt motion errors, as well as other errors introducing print imperfections. As one example, deviations in the relative marking material deposition on the substrate media from the expected and/or desired locations can be caused by cyclical belt motion errors. Error values can be measured using an expected and actual location of the marking material on the substrate and/or an actual location of the marking material on the substrate relative to the actual location of other marking material on the substrate.

In some embodiments, at least one test pattern can be printed for each media panel and error values can be calculated for each panel. In some embodiments, multiple test patterns can be printed for each media panel and average error values can be calculated for each panel. Using the error values identified by the test patterns, image placement correction factors can be generated on a per panel basis. The image placement correction factors can be stored in a correction table in the storage for subsequent retrieval and use in the calibration and/or printing process.

In an exemplary printing process, the printing system is configured for a printing job. For example, the size of the substrate media and one or more images are specified. The number and location of panels on the belts can be determined based on the configuration for the print job. To begin, substrate media, such as sheets of paper, are transported past the printing station 318 in the process direction 302 by the media transport belt 310 such that the substrate media is substantially aligned with the media panels of the media transport belt 310. One or more of the controllers retrieve the image placement correction factors from storage for the panels and configures the image marking units with the image placement correction factors so that color-to-color registration errors can be mitigated on a per panel basis during the printing operation. The image placement correction factors can cause the image marking units to adjust the location from which marking material is disposed from the print heads of image marking units on to the substrate media passing by the printing station 318 to counteract color-to-color registration errors on a per panel basis.

The substrate media is positioned on one of the media panels of the media transport belt 310. The media transport belt transports the substrate media past the printing station 318, which disposes an image to the substrate media using the image marking units 321-328.

Once the image is disposed on the substrate media, the substrate media continues to be transported in the process direction away from the printing station 318 and the image marking units receive at least one image place correction factor for the next media panel transporting substrate media on which an image is to be disposed. Thus the printing system 300 can compensate for cyclical belt motion errors on a per panel basis, where each panel can correspond to an image placement correction factor generated during a calibration process.

Table 1 is a correction table for a default transfer roller position, which can be generated in response to a calibration process performed by a printing system implemented as a MOP printing system. In the present example, the printing system can include a media transport belt having eight media panels and an intermediate transfer belt having four image panels each so that for the default transfer roller position there are eight possible panel combinations. The image place correction factor in the present example corresponds to values for adjusting one or more image marking units in the cross process direction to change the location at which marking material is disposed to counteract the cyclical belt motion errors in the printing system associated with the default position of the transfer roller. A correction table similar to Table 1 can be generated when the printing system is a Direct-to-Paper (DOP) printing system except that there are no columns for transfer roller position and image panels, since a DOP printing system generally does not include these components.

TABLE 1

| Transfer Roller Position | Media Panel | Image Panels | Cross-process Image Placement Correction Factor |
|---|---|---|---|
| 0 mm (Default) | 1 | 1 | 0.4 mm |
| | 2 | 2 | 0.24 mm |
| | 3 | 3 | 0.11 mm |
| | 4 | 4 | 0.01 mm |
| | 5 | 1 | 0.125 mm |
| | 6 | 2 | 0.25 mm |
| | 7 | 3 | 0.5 mm |
| | 8 | 4 | 0.53 mm |

Figure 4:
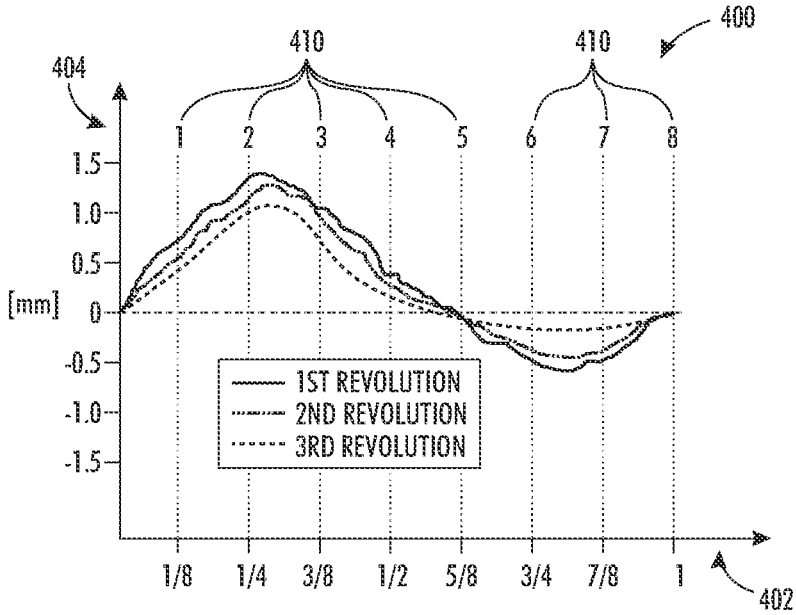
FIG. 4 is a graph illustrating exemplary lateral (e.g., cross process) belt motion errors of a media transfer belt and/or an intermediate transfer belt revolving about rollers in a printing system.

FIG. 4 is a graph 400 illustrating exemplary lateral (e.g., cross process) cyclical belt motion errors of a media transfer belt and/or an intermediate transfer belt revolving about rollers in the printing system 200 and/or 300. The x-axis 402 of the graph 400 represents a revolution of the belt and the y-axis 404 of the graph represents distance in millimeters (mm) that the belt moves as it rotates, where the default, expected, and/or intended belt location is zero millimeters (0 mm). Panel markers 410 are included in the graph 400 for indicating the location of panels relative to the rotation of the belt. In the present example, the belt can include eight panels. As shown in the graph 400, a periodic cyclical belt motion error exists that has a substantially identical period to the belt's once-around period.

In the present example, three revolutions of the belt are overlaid to illustrate variation in the magnitude of the cyclical belt motion errors for different revolutions of the belt. Each of the revolutions can result in similar cyclical belt motion error values for corresponding panels. In some embodiments, during calibration two or more test patterns can be printed from each panel, one test pattern per rotation of the belt. The error values identified for a panel over multiple revolutions can be averaged to compute an averaged error value for the panel, which can be used to calculate an image placement correction factor for the panel.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A multi-belt printing system comprising:

a first and second printing station, each including a rotating intermediate transfer belt having image panels, a marking unit configured to dispose marking material on the image panels, and a transfer point at which the marking material is transferred to substrate media from the image panels;

a rotating media transport belt having a plurality of media panels adapted to support the substrate media thereon, the media transport belt configured to transport the media panels past each transfer point to facilitate transfer of the marking material to the substrate media from the image panels, the image panels of the first and second printing stations periodically coinciding with at least one of the media panels at the transfer point associated with the image panels to form panel combinations; and a controller to control the marking unit of at least one of the first and second printing stations to adjust placement of the marking material individually for each of the panel combinations to compensate for combined registration errors associated with each of the panel combinations, wherein at least one test pattern is printed for each of the panel combinations to detect combined registration errors corresponding to each of the panel combinations, a set of image placement correction factors being generated based on the at least one test pattern printed for each of the panel combinations, the set of image placement correction factors including at least one image correction factor for each of the panel combinations, and wherein the controller applies the set of image placement correction factors for the panel combinations to control the marking unit to adjust the placement of the marking material.

2. The system of claim 1, wherein the printing system is a multicolor printing system, the marking unit of the first printing station disposing a first color marking material, the marking unit of the second printing station disposing a second color marking material, the combined registration errors being a color-to-color registration error resulting from a misalignment of the first color marking material with respect to the second color marking material on the substrate media due to cyclical belt motion errors associated with at least one of the media transport belt, the intermediate transfer belt associated with the first printing station, and the intermediate transfer belt associated with the second printing station.

3. The printing system of claim 1, wherein each of the panel combinations includes one of the image panels from the first printing station, one of the image panels from the second printing station, and one of the media panels from the media transport belt, the image panels from the first printing station periodically coinciding with the one of the media panels at the transfer point of the first printing station and the one of the image panels from the second printing station periodically coinciding with the one of the media panels at the transfer point of the second printing station.

4. The system of claim 3, wherein a first one of the combined registration errors associated with a first one of the panel combinations comprises a misalignment associated with a first one of the media panels, a first one of the image panels from the first printing station, and a first one of the image panels from the second printing station.

5. The system of claim 1, wherein the first one of the combined registration errors corresponds to an average combined registration error calculated based on a plurality of revolutions of the media transport belt and each intermediate transfer belt.

6. The system of claim 1, wherein the controller determines a quantity of panel combinations based on a lowest common multiple of media panels to image panels from each of the first and second printing stations and the controller generates the set of image placement correction factors based on the lowest common multiple.

7. A method of compensating registration errors in a printing system comprising:

identifying panel combinations, each of the panel combinations including an image panel from a first intermediate transfer belt, an image panel from a second intermediate transfer belt, and a media panel from a media transport belt, the image panel from the first intermediate transfer belt periodically coinciding with the media panel at a first transfer point and the image panel from the second intermediate transfer belt periodically coinciding with the media panel at a second transfer point;

identifying image placement correction factors for each of the panel combinations, the image placement correction factors being used to compensate for registration errors associated with the panel combinations;

controlling a marking unit associated with one of the first and second intermediate transfer belts to adjust placement of the marking material individually for each of the panel combinations in response to the image placement correction factors;

identifying a lowest common multiple between media panels, the image panels associated with the first intermediate transfer belt, and the image panels of the second intermediate transfer belt; and generating a set of the image placement correction factors based on the lowest common multiple, the set of the image placement correction factors including at least one image correction for each of the panel combinations.

8. The method of claim 7, wherein the printing system is a multicolor printing system and the method comprises:

disposing a first color marking material with the marking unit of a first printing station; and disposing a second color marking material with the marking unit of a second printing station, the combined registration errors being color-to-color registration errors resulting from a misalignment of the first color marking material with respect to the second color marking material on the substrate media due to cyclical belt motion errors associated with at least one of the media transport belt, the intermediate transfer belt associated with the first printing station, and the intermediate transfer belt associated with the second printing station.

9. The method of claim 7, wherein each of the panel combinations includes one of the image panels from a first printing station, one of the image panels from a second printing station, and one of the media panels from the media transport belt, the image panels from the first printing station periodically coinciding with the one of the media panels at the transfer point of the first printing station and the one of the image panels from the second printing station periodically coinciding with the one of the media panels at the transfer point of the second printing station.

10. The method of claim 7, wherein a first one of the combined registration errors associated with a first one of the panel combinations comprises a misalignment associated with a first one of the media panels, a first one of the image panels from a first printing station, and a first one of the image panels from a second printing station.

11. The method of claim 7, further comprising;

determining a first one of a second set of image placement correction factors using an average combined registration error for a first one of the panel combinations, the average being based on a plurality of revolutions of the media transport belt.

12. The method of claim 7, further comprising:

printing at least one test pattern for each of the panel combinations;

sensing calibration patterns to detect the registration errors corresponding to each of the panel combinations, the registration errors due to cyclical belt motion errors; and generating a second set of image placement correction factors based on the at least one test pattern.

13. A system to compensate for registration errors in a multi-belt printing system comprising:

a computer storage device to store image placement correction factors for each panel combination, each panel combination including an image panel from a first rotating intermediate transfer belt, an image panel from a second rotating intermediate transfer belt, and a media panel from a rotating media transport belt, the image panel from the first intermediate transfer belt periodically coinciding with the media panel at a first transfer point and the image panel from the second intermediate transfer belt periodically coinciding with the media panel at a second transfer point;

a first marking unit associated with the first intermediate transfer belt to dispose a first marking material on the image panel of the first intermediate transfer belt, the first marking material being transferred to the media panel at the first transfer point;

a second marking unit associated with the second intermediate transfer belt to dispose a second marking material on the image panel of the second intermediate transfer belt, the second marking material being transferred to the media belt at the second transfer point; and a controller to control the second marking unit to adjust placement of the second marking material in response to the image placement correction factors to compensate for a combined registration error associated with each panel combination.

14. The system of claim 13, wherein the second transfer point is downstream from the first transfer point.

15. The system of claim 13, wherein the first transfer point is downstream from the second transfer point.

16. The system of claim 13, wherein the printing system is a multicolor printing system, the marking unit associated with the first intermediate transfer belt disposing a first color marking material, the marking unit associated with the second intermediate transfer belt disposing a second color marking material, the combined registration error being a color-to-color registration error resulting from a misalignment of the first color marking material with respect to the second color marking material on substrate media supported by the media panels due to cyclical belt motion errors associated with at least one of the media transport belt, the first intermediate transfer belt, and the second intermediate transfer belt.

17. The system of claim 13, wherein the set of image placement correction factors includes at least one image placement correction factor for each of the panel combinations.

18. The system of claim 13, wherein the controller determines a quantity of panel combinations based on a lowest common multiple between media panels and image panels associated with each of the first and second intermediate transfer belts, and the controller generates a set of image placement correction factors based on the lowest common multiple, the set of image placement correction factors being used to compensate for the combined registration errors associated with the panel combinations.

19. The system of claim 18, wherein the set of image placement correction factors includes at least one image placement correction factor for each of the panel combinations.

20. The system of claim 13, wherein at least one test pattern is printed for each panel combination to detect combined registration errors corresponding to each of the panel combinations, a set of image placement correction factors being generated based on the at least one test pattern printed for each of the panel combinations, the set of image placement correction factors including at least one image correction factor for each of the panel combination, and wherein the controller applies the set of image placement correction factors for the panel combinations to control the marking unit to adjust the placement of the marking material.

21. A multi-belt printing system comprising:

a first and second printing station, each including a rotating intermediate transfer belt having image panels, a marking unit configured to dispose marking material on the image panels, and a transfer point at which the marking material is transferred to substrate media from the image panels;

a rotating media transport belt having a plurality of media panels adapted to support the substrate media thereon, the media transport belt configured to transport the media panels past each transfer point to facilitate transfer of the marking material to the substrate media from the image panels, the image panels of the first and second printing stations periodically coinciding with at least one of the media panels at the transfer point associated with the image panels to form panel combinations; and a controller to control the marking unit of at least one of the first and second printing stations to adjust placement of the marking material individually for each of the panel combinations to compensate for combined registration errors associated with each of the panel combinations, wherein the controller determines a quantity of panel combinations based on a lowest common multiple of media panels to image panels from each of the first and second printing stations and the controller generates a set of image placement correction factors based on the lowest common multiple, the set of image placement correction factors being used to compensate for the combined registration errors associated with the panel combinations.

22. The system of claim 21, wherein the set of image placement correction factors includes at least one image placement correction factor for each of the panel combinations.

23. The system of claim 21, wherein the printing system is a multicolor printing system, the marking unit of the first printing station disposing a first color marking material, the marking unit of the second printing station disposing a second color marking material, the combined registration errors being a color-to-color registration error resulting from a misalignment of the first color marking material with respect to the second color marking material on the substrate due to cyclical belt motion errors associated with at least one of the media transport belt, the intermediate transfer belt associated with the first printing station, and the intermediate transfer belt associated with the second printing station.

24. The system of claim 21, wherein each of the panel combinations includes one of the image panels from the first printing station, one of the image panels from the second printing station, and one of the media panels from the media transport belt, the image panels from the first printing station periodically coinciding with the one of the media panels at the transfer point of the first printing station and the one of the image panels from the second printing station periodically coinciding with the one of the media panels at the transfer point of the second printing station.

25. The system of claim 24, wherein a first one of the combined registration errors associated with a first one of the panel combinations comprises a misalignment associated with a first one of the media panels, a first one of the image panels from the first printing station, and a first one of the image panels from the second printing station.

26. The system of claim 21, wherein the first one of the combined registration errors corresponds to an average combined registration error calculated based on a plurality of revolutions of the media transport belt and each intermediate transfer belt.

* * * * *